US008087526B2

(12) United States Patent
Dovey et al.

(10) Patent No.: US 8,087,526 B2
(45) Date of Patent: Jan. 3, 2012

(54) KNOCKDOWN STORAGE VESSEL

(75) Inventors: Zach Seth Dovey, London (GB); Heather Dovey, Cape Town (ZA)

(73) Assignee: Celdo Ltd., London (GB)

( * ) Notice: Subject to any disclaimer, the term of this patent is extended or adjusted under 35 U.S.C. 154(b) by 965 days.

(21) Appl. No.: 11/607,588

(22) Filed: Dec. 1, 2006

(65) Prior Publication Data

US 2008/0128412 A1 Jun. 5, 2008

(51) Int. Cl.
*B65D 6/00* (2006.01)
*B65D 8/00* (2006.01)

(52) U.S. Cl. ..... 220/4.08; 220/4.09; 220/4.12

(58) Field of Classification Search ..... 220/4.08, 220/592.19, 691, 4.09, 4.12, 4.16, 4.26, 4.28, 220/495.01, 495.03, 495.05; 294/4
See application file for complete search history.

(56) References Cited

U.S. PATENT DOCUMENTS

| | | | | |
|---|---|---|---|---|
| 1,499,574 | A * | 7/1924 | Evans | 294/4 |
| 2,090,668 | A * | 8/1937 | Deutsch | 220/4.08 |
| 2,843,414 | A * | 7/1958 | Findiesen | 294/4 |
| 2,991,916 | A * | 7/1961 | Kish | 222/386.5 |
| 4,071,160 | A | 1/1978 | Vick | |
| 5,944,417 | A * | 8/1999 | Shiotani | 366/220 |
| 6,846,503 | B2 | 1/2005 | Vickers, Jr. | |
| 6,999,849 | B2 | 2/2006 | Bridges | |

FOREIGN PATENT DOCUMENTS

| | | |
|---|---|---|
| GB | 1 476 638 | 3/1975 |
| GB | 1483451 A | 8/1977 |

OTHER PUBLICATIONS

Extended European Search Report, Feb. 3, 2010, European Application No. 07870460.8, 5pgs.

* cited by examiner

*Primary Examiner* — Bryon Gehman
*Assistant Examiner* — Shawn Braden
(74) *Attorney, Agent, or Firm* — The Marbury Law Group, PLLC

(57) ABSTRACT

A knockdown storage vessel has an internal bladder and external barrel sections. The ends of two barrel sections include a centrally-located bush that can be engaged by a handle so as to secure the barrel sections and allow for rolling transport of the vessel. The vessel barrel sections are dimensioned so as to nest within one another for compact storage.

13 Claims, 6 Drawing Sheets

KNOCKDOWN STORAGE VESSEL

BACKGROUND OF THE INVENTION

The present invention relates to a knockdown storage vessel for liquids and dry goods. As used herein, the term "knockdown" refers to being constructed in separate parts that can readily be taken apart for easy storage, shipping, etc.

A prior art "Collapsible Vessel for Liquids" is disclosed in GB Pat. No. 1,476,638 and includes a three-piece reinforced plastic vessel in which the vessel is held together and sealed with axial pressure applied by a handle frame. This vessel is shaped so as to be rolled by a user. This system relies upon multiple O-ring seals to form the water-tight vessel and uses a conventional bung or plug for filling and discharging water.

It would be desirable to have a knockdown vessel for liquids and/or dry goods that that can be used to transport an amount of materials too heavy for an ordinary user to carry, and that is suited for carrying multiple different types of liquid and dry goods without requiring cleaning of the major structural components.

BRIEF SUMMARY OF THE INVENTION

The present invention provides a knockdown storage vessel for liquids and/or dry goods that allows for easy transport by a user. The liquids and/or dry goods are stored in a bladder that is encased in a rigid barrel formed from multiple nesting sections. The barrel sections are held together by a handle that allows the user to roll the vessel and thus transport larger quantities than can be lifted.

The disclosed storage vessel can be disassembled into a compact configuration for storage due to the nesting of the barrel sections and flexibility of the bladder.

The bladder of the disclosed storage vessel provides water-tight storage to retain liquids and/or protect dry goods.

The use of different bladders for the storage of different material allows the knockdown storage vessel to be used for storage and transport of different materials without the need for cleaning of the barrel sections.

In an embodiment, an end section of the barrel includes a hole and the bladder includes a gland so as to allow filling and dispensing of material from the vessel. A tap assembly is further disclosed for dispensing of liquids.

In an embodiment, the barrel of the storage vessel includes one or more raised circumferential portions that contact the ground and lower the rolling resistance of the vessel assembly.

In another embodiment, the handle of the storage vessel converts into a frame to support the vessel in a manner to aid in dispensing liquids from the tap assembly.

DETAILED DESCRIPTION OF THE INVENTION

Figure 1:
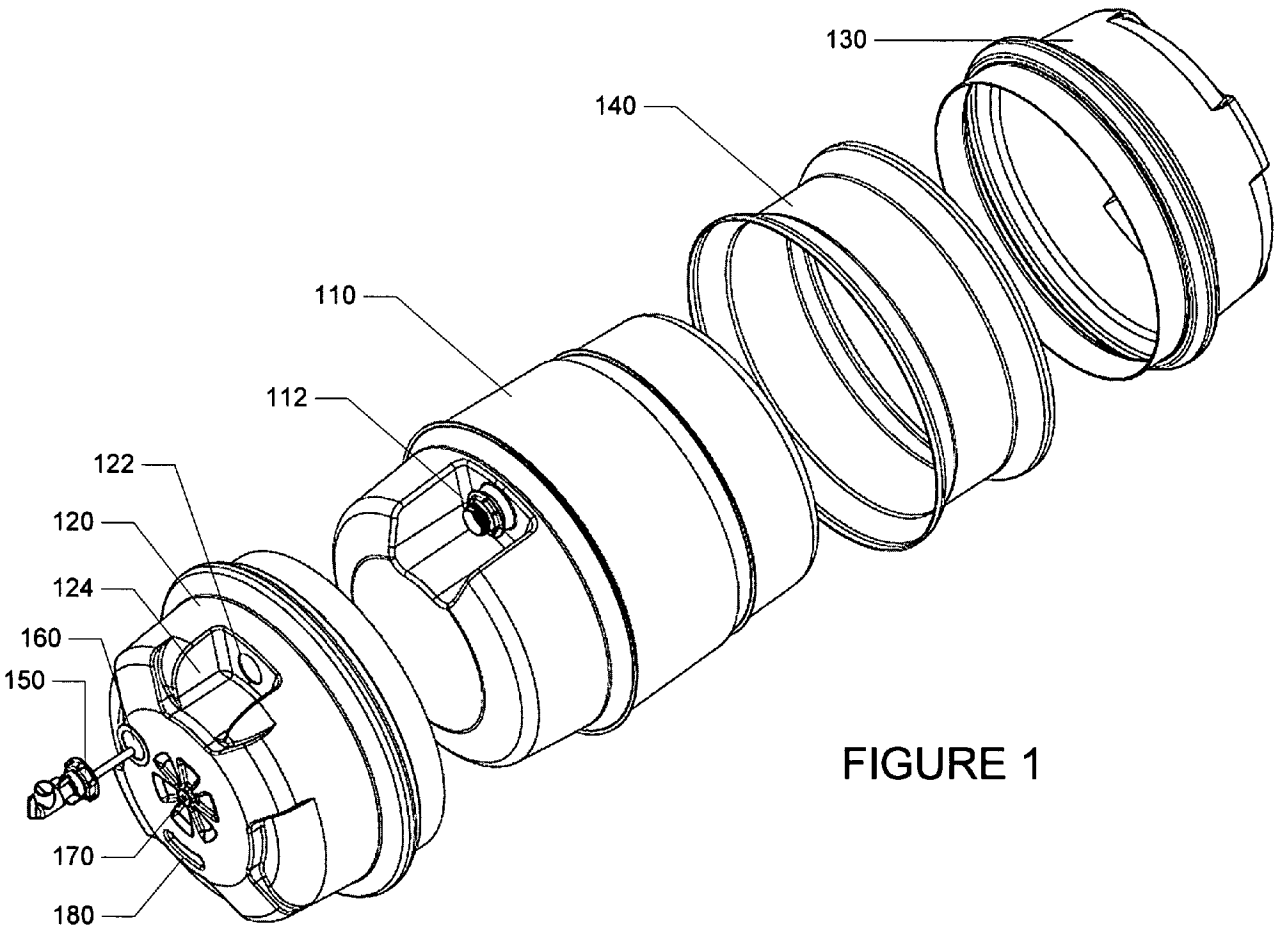
FIG. 1 illustrates an exploded view of an embodiment of the storage vessel of the present invention.

An embodiment of the knockdown vessel is shown in FIG. 1 and comprises a substantially cylindrical bag or bladder 110 (hereinafter, bladder) formed of a suitably impervious flexible material and an outer barrel comprising substantially cylindrical hollow end sections 120 and 130, and a central section 140. The barrel sections 120, 130, and 140 can be made of any suitably rigid and durable material and are preferably made of a rigid plastic material, which may optionally be reinforced. The bladder 110 includes a gland assembly 112 for filling and dispensing material from the bladder 110. Hollow end section 120 includes a hole 122 through which a neck portion of the gland assembly 112 can extend through and be secured with a tap assembly 150 and washer 160 or a washer, lock-ring and cap (not shown). In a preferred embodiment, the hole 122 is located within a recessed area 124 sized to accommodate the tap assembly 150 so as to protect the tap assembly during transport and use.

Figure 2:
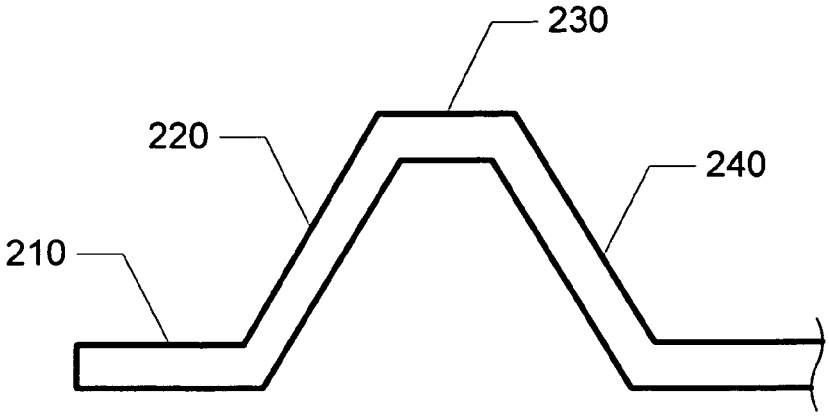
FIG. 2 illustrates details of the edges of an embodiment of the barrel end sections of the present invention.

As illustrated in FIGS. 1 and 2, in one embodiment of the invention, the rim portions 124 and 134 of each end section 120 and 130 have a cylindrical leading edge 210 followed by a raised circumferential portion formed generally from opposing inner frusto-conical surface 220 and outer frusto-conical surface 240 joined by a small, generally cylindrical surface 230. As illustrated in FIG. 1, each edge 144 of central section 140 also has substantially matching frusto-conical surface that encompass and bear on the inner frusto-conical surfaces 220 of rim portions 124 and 134 of end sections 120 and 130, respectively, when in an assembled state. In this manner, the assembled vessel will contact the ground on the raised circumferential structures formed by the frusto-conical surfaces. The overlapping of the frusti-conical surfaces provides reinforcement to the structure at the load-carrying contact points. In this particular configuration, the outer edges of central section 140 are subject to wear from rolling. While these surfaces of the invention will typically formed from a highly wear-resistant material such as PTFE, various options exist to address this wear if needed, including but not limited to: having the central sections be separately replaceable; forming the central section or edge thereof from more wear-resistant material; forming the edges for the central section with a thicker layer of material; and adding a flexible wear-resistant tread to the outer portion of the edges of the central section.

Each end section further includes a central bush 170 to which a handle frame (illustrated in FIGS. 4A and 4B) is attached with lugs. As depicted in the illustrated embodiment, the area adjacent the bush can be contoured to increase stiffness and strength to this contact area. The bush 170 is preferably formed or lined with a durable low friction material such as nylon or PTFE. In one embodiment, the lugs that interact with the bushes adjustably screw into the bushes so as to be easily separable. The handle frame prevents the barrel sections from separating along a longitudinal axis and allows the user to roll the knockdown vessel. The end sections can further include recessed, molded-in handles 180 to assist in manipulating the vessel. Ribs and other such structures can be molded into the barrel sections to provide stiffening.

Figure 3:
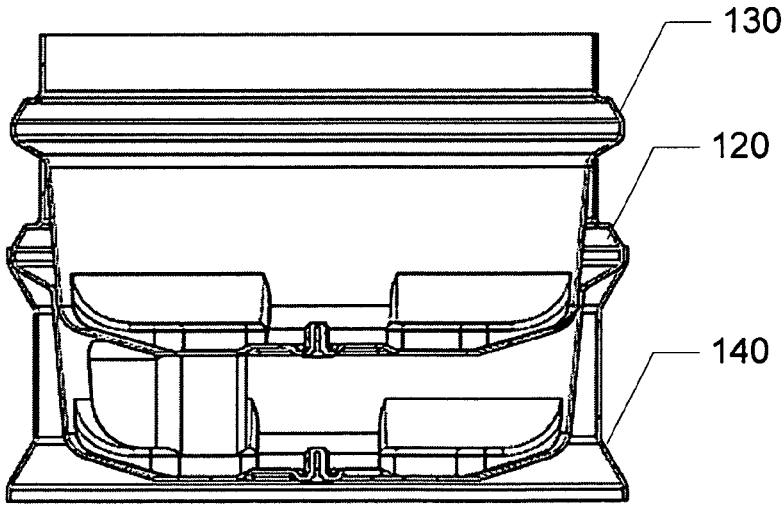
FIG. 3 illustrates a cross-section view of a collapsed embodiment of the storage vessel of the present invention.

As shown in FIG. 3, the three barrel sections may be stacked together by inserting end section 130 within end section 120, and inserting said end section 120 within the central section 140. For this purpose, the substantially cylindrical portion end section 130 is formed with an outside diameter substantially equal to the inside diameter of the substantially cylindrical portion of end section 120, and in turn the outside diameter of the substantially cylindrical portion of end section 120 is substantially equal to the inside diameter of the central section 140. In this way, the barrel sections can be nested for storage when collapsed. To aid in this, the two end sections 120 and 130 can be slightly tapered towards their closed ends.

Figure 4A:
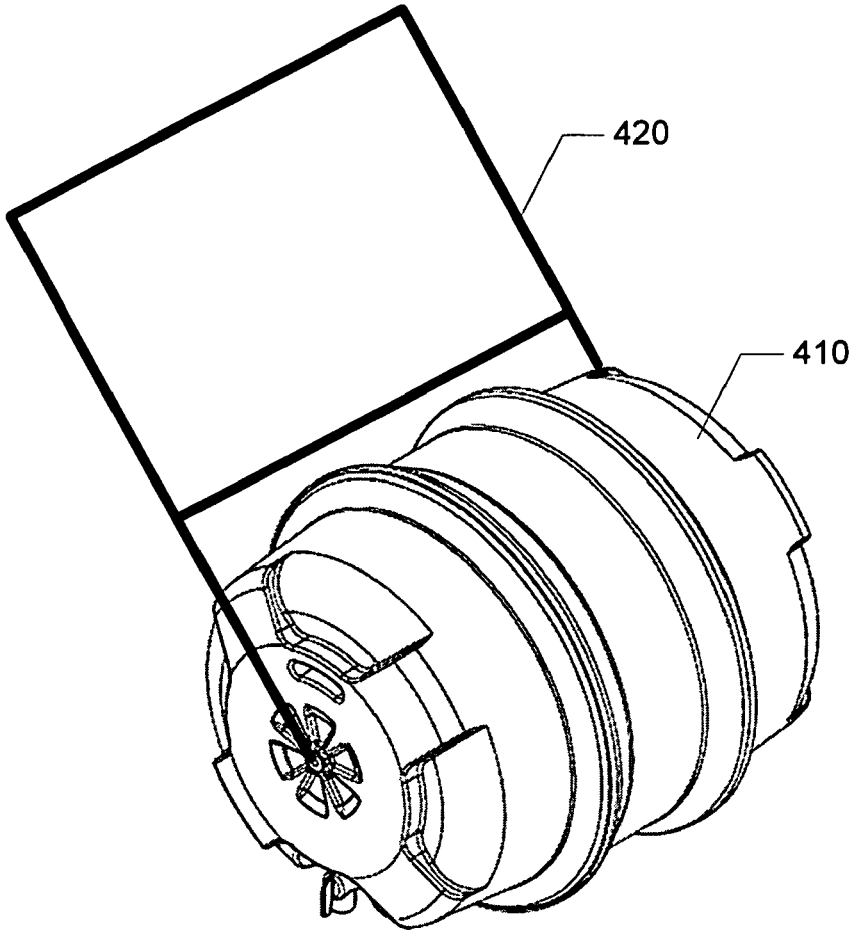
FIGS. 4A and 4B illustrate assembled views of an embodiment of the storage vessel of the present invention combined with a handle frame.
Figure 4B:
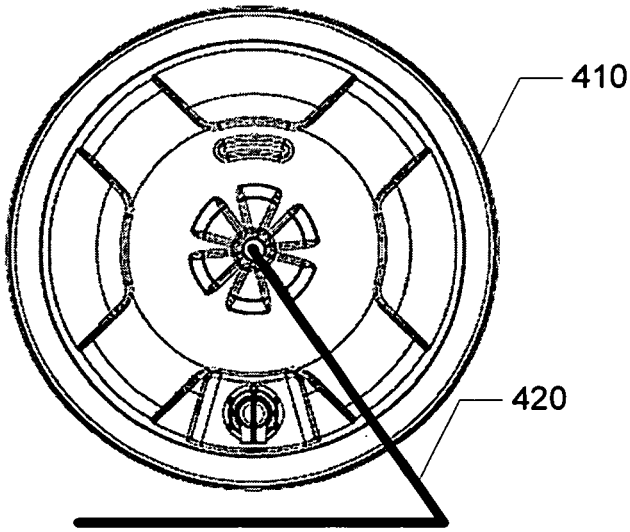
Figure 4C:
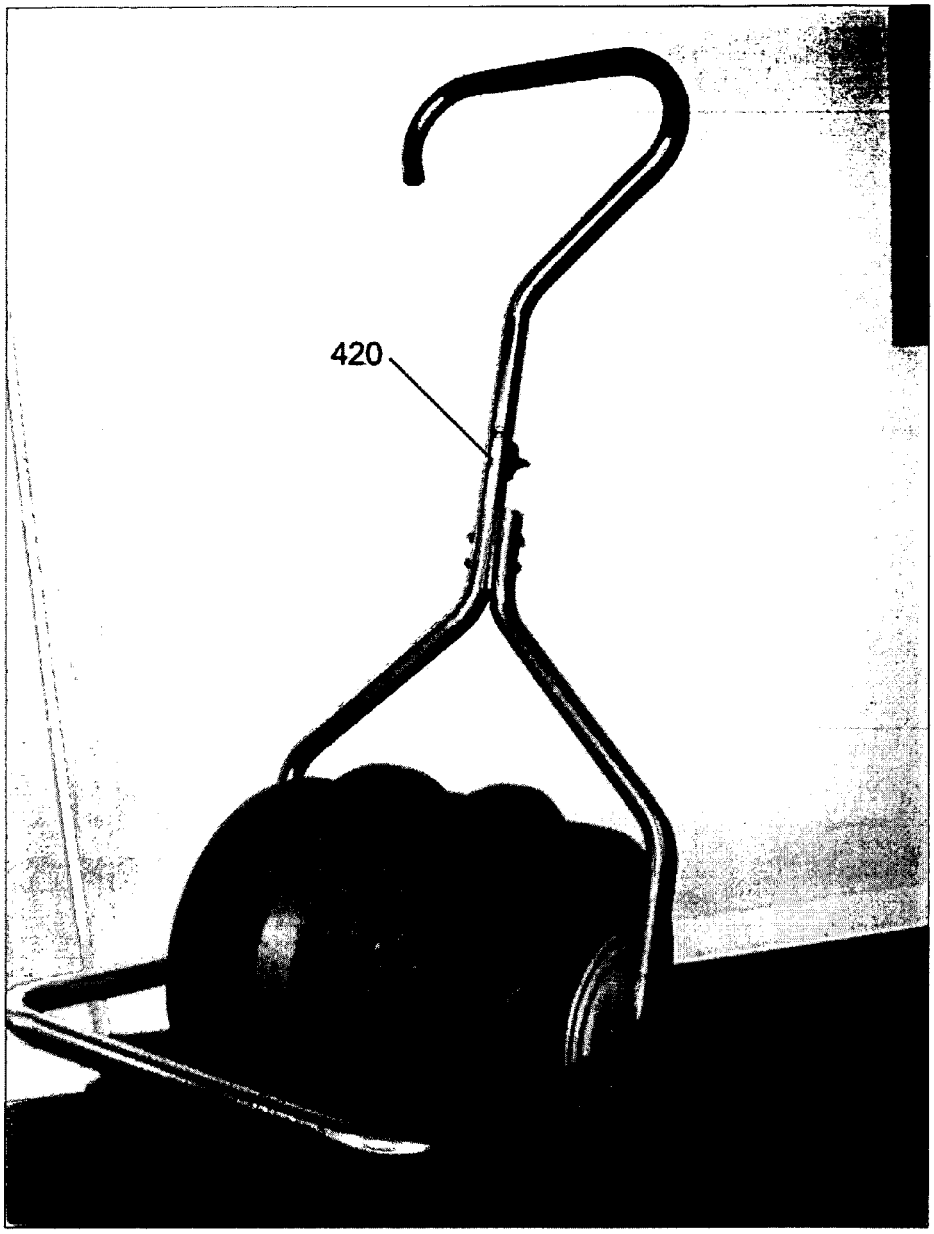
FIG. 4C illustrates an alternate embodiment of the storage vessel of the present invention combined with a handle frame.

In an embodiment of the invention illustrated in FIGS. 4A and 4B, the knockdown vessel is shown in an assembled state, wherein the handle frame 420 holds the sections of barrel 410 together. FIG. 4A illustrates the handle frame 420 in a configuration for a user to push or pull the barrel 410. FIG. 4B illustrates the handle frame 42 converted to a support configuration useful for dispending of liquids. The handle frame 420 can be converted in any suitable manner, including but not limited to pivoting and interlocking upper and lower frames. The folding or disassembly of the handle frame 420 further adds to the knockdown nature of the apparatus and allows it to be stored in a smaller area. FIG. 4C illustrates the knockdown vessel in an assembled state with another embodiment of the handle frame 420.

Figure 5A:
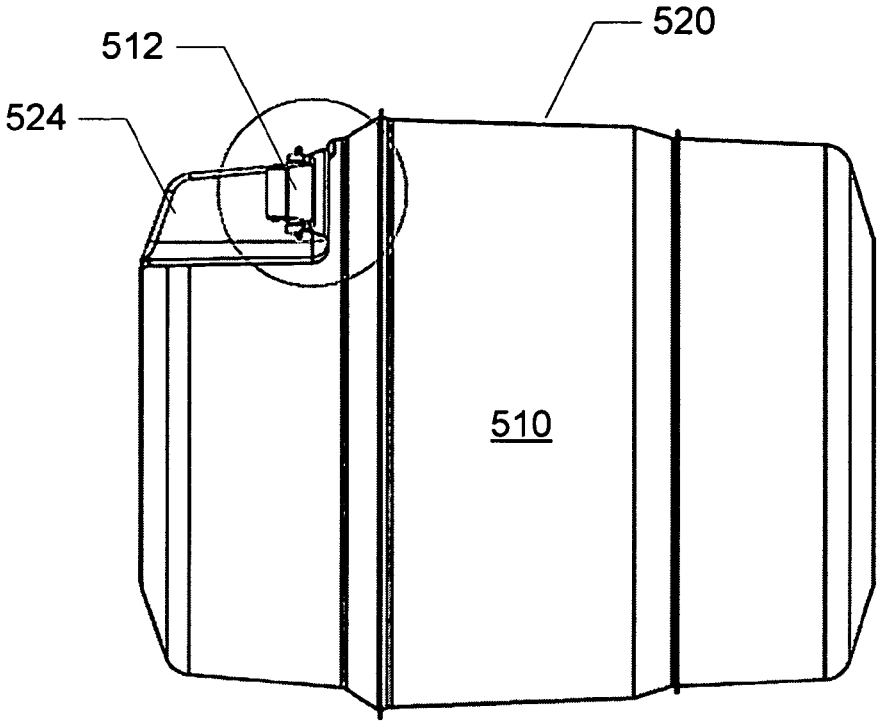
FIGS. 5A and 5B illustrate a cross-section of an embodiment of the bladder of the present invention and details of the an embodiment of the gland used therein.
Figure 5B:
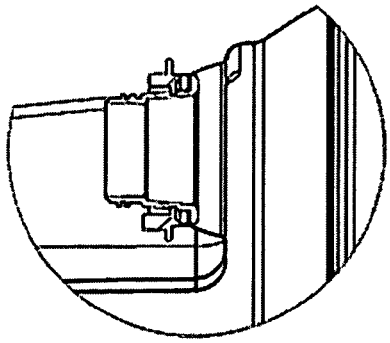

FIG. 5A illustrates cross-section of an embodiment of the bladder 510. The outer wall 520 tapers towards the ends the bladder 510 to ease assembly of the vessel and generally match the contours of the barrel sections. In this embodiment, gland assembly 512 is located in a recess 524 that generally matches recess 124. FIG. 5B illustrates further details of a cross section of gland assembly 512.

Figure 6:
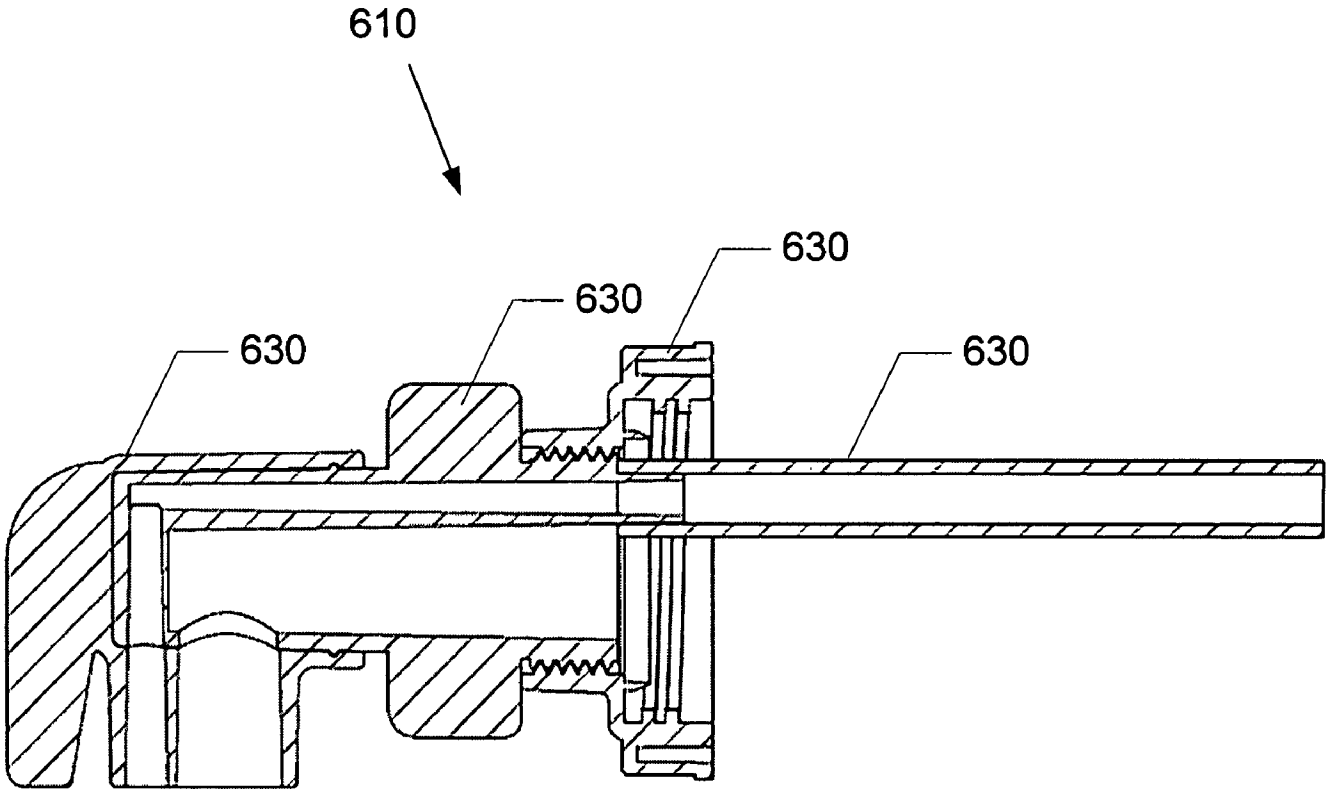
FIG. 6 illustrates a cross-section of an embodiment of a tap assembly in accordance with the present invention.

An embodiment of the invention can use a tap assembly 610 for the dispensing of liquids, as illustrated in FIG. 6. As shown in the cross-section, the tap assembly includes a body 620, an air tube 630, a collar 640, and an actuator 650. In use, the collar 640 attaches to the gland of the bladder with a first set of threads and uses a pliable washer to seal the assembly. The body 620 of the tap assembly is threaded into a second set of threads on collar 640 and tightened by hand using bosses on the body 620. The body 620 has a liquid passage and an air passage that can be alternately opened and closed via rotation of actuator 650. Air tube 630 is connected to the air passage to extend the conduit further into the vessel.

While disclosed with respect to certain embodiments, the invention is not meant to be limited to any particular embodiment. In one embodiment, a system for transporting liquids or dry goods comprises vessel components comprised of at least an internal bladder and at least two external barrel sections. This system includes a handle that retains the barrel sections along a central axis thereof and allows rotation of the vessel about the central axis. The internal bladder includes a gland that extends through an external barrel section and the gland is sealed by any known means. At least two vessel components of the system are storable in a nested manner when disassembled. In a variation of this system, the gland can be sealed with a tap assembly or a cap. In another variation, the storable vessel components comprises a first end barrel section dimensioned to nest in a central barrel section and a second end barrel section dimensioned to nest in the first end barrel section.

Another embodiment is to a method of transporting liquids or dry goods that comprises storing at least two knockdown vessel components in a nested manner; assembling vessel components comprised of at least an internal bladder and at least two external barrel sections; retaining the barrel sections along a central axis thereof with a handle that allows rotation of the vessel about the central axis; filling the internal bladder with liquids or dry goods via a gland; sealing the gland; and transporting the liquids or dry goods by applying force to the handle to roll the vessel. Variations of the method include sealing the gland by insertion of a tap assembly or attachment of a cap. Another variation includes nesting a first end barrel section in a central barrel section and nesting a second end barrel section in the first end barrel section.

A further embodiment is to a knockdown vessel that comprises a bladder having a first end including a gland, a center portion, and a second closed end. A rigid center section with a circular cross-section, a first frusti-conical edge, and a second frusti-conical edge, is sized to encompass the center section of the bladder. Similarly, a rigid first end section has an end wall, is sized at an opposing end to longitudinally mate to the first frusti-conical edge of the rigid center section, and is dimensioned to encompass the first end of the bladder, and a rigid second end section has an end wall, is sized at an opposing end to longitudinally mate to the second frusti-conical edge of the rigid center section, and dimensioned to encompass the second end of the bladder.

In a variation on this embodiment, the rigid first end section is sized to nest within the rigid center section and the rigid second end section is sized to nest within the rigid first end section when in a collapsed state. In other variations, the rigid first end section further includes a centrally-located bush in the end wall and a recessed portion with an opening for the gland and the rigid second end section further includes a centrally-located bush in the end wall such that a handle frame including lugs can interact with the bushes and prevent the sections from separating along a longitudinal axis.

In another embodiment, the handle frame includes means, such as a pivot or a series of differently-positioned lugs, to convert the handle frame into a support for the vessel. Optionally, the lugs can adjustably screw longitudinally into and out of the bushes so as to be easily separable. As an aid to the nesting of the components, in an embodiment, the rigid first and second end section can be tapered in a direction towards the end wall of each end section. In another embodiment, the rigid first end section can further include a recessed portion with an opening for the gland. This embodiment can optionally include a tap assembly for engaging the gland through the opening.

Example 1

In one embodiment, a knockdown vessel is provided for use by campers, recreational vehicle (RV) users and the like when transporting a large quantity of water which is too heavy for normal lifting. Typically, campers and RV users require large quantities of water from an external supply for washing and drinking. In camping and RV sites, the water supply is often some distance from the tent or RV emplacements, and it is thus desirable to have a vessel which may contain a large quantity of water, yet which may easily be transported from the water supply to the emplacement. At the same time the vessel should not take up an unreasonable amount of space when not in use.

In the prior art, campers and RV users have purchased drinking water in 1-3 gallon expendable plastic containers or purchased a reusable plastic container in the form of collapsible 2-10 liter bags or rigid/collapsible 3-7 gallon containers made of polyethylene. The sizes of these containers have been limited by the weight that a typical user can carry. For example, water weighs approximately 8.34 pounds per gallon or 2.2 pounds (1 kg) per liter, so a seven gallon container of water weighs over 58 pounds. Indeed, for this reason, many standard liquid containers are limited to the 5 gallon/20 liter size, such as "gerry can" type containers.

However, by use of an embodiment of the presently-disclosed knockdown container, a 45 liter (11.89 gallon) vessel, weighing 45 kilograms (99 pounds) when filled with water, can be transported by a single person.

Example 2

Embodiments of the knockdown vessel have further utility for liquid and dry good storage and transport for emergency purposes and/or for use in remote or third-world locations, such as for water, fuel, rice, flour, powdered milk, etc. Embodiments allow reuse of the vessel for diverse purposes without requiring cleaning by merely replacing the bladder.

Containers typically used for emergency purposes and/or in remote or third-world locations are not necessarily limited to sizes that a user can carry 55 and 30 gallon drums are commonly used for these purposes, but the drums take up significant storage space when empty and weigh an unwieldy 462 and 253 pounds, respectively, when full of water. These drums also usually require a bung wrench to access the container and a siphon pump to remove the liquid therefrom. Less-commonly used is a 15 gallon drum that can weigh nearly 130 pounds when full of water. These 15 gallon drums include a pair of handles on the top end so that they can be carried by two people.

Use of a 45 liter embodiment of the knockdown storage vessel allows a single user to transport nearly as much as two users of prior art devices. A tap assembly recessed into one end of the vessel allows convenient filling and dispensing of the liquids from the vessel.

Example 3

With respect to dry goods, such as grain, powdered food, cement, etc., the prior art typically uses sacks to store and transport the goods. Again, users in remote areas are often limited by the weight of goods they can carry and the sacks are sized accordingly. Sometimes, however, the sacks are very large and must be opened and the goods transferred to a smaller vessel for users to carry away. In many instances, the sacks and/or smaller vessels are not liquid-tight and the materials can be subject to spoilage.

An embodiment of the knockdown vessel allows filling of the bladder with fluent dry goods (rice, wheat, dry milk, dry cereal, cement, pharmaceuticals, etc.) through the gland assembly. The vessel is sealed with a cap on the gland assembly, and rolled to transport and store the dry goods in a sealed, water-tight manner to prevent spoilage.

Example 4

For dry goods stored in manageably-sized sacks, an embodiment of the invention can use a wide-opening bladder to encompass and seal the dry goods within the sack. Such a bladder can use a press and lock, zipper-like seal (i.e., Zip-Loc®) to close and seal the bladder. The barrel of the vessel is then assembled around the bladder and used to transport the dry goods by rolling.

Example 5

The knockdown vessel can be easily used to store and transport different materials, especially liquids, without the need to clean the barrel components by merely switching bladders. Because of this, the invention has utility in the beverage industry, including wine, beer, and spirits. Presently, kegs used for beer must be returned and cleaned for reuse. The empty kegs are heavy and take up as much space during transport as a full keg. The present invention allows disposal of used bladders and transport of the (knocked down) nested barrel components, which are lighter and more compact, to a location to be refilled.

In the beer, wine, and spirits industries, the beverages (i.e., stout beer, chardonnay wine, whiskey) are often aged or matured in oak casks or metal tanks with oak chips. However, the oak casks are expensive and not always easily reusable, and the metal tanks must be cleaned between batches. By use of the present invention, beer, wine, and spirits can be matured in a vessel of the present invention using a bladder containing oak chips and the vessels easily reused by simple replacement of the bladder. Furthermore, the use of the bladder also allows such beverages to be dispensed without being subject to spoilage/oxidation due to contact with air (as presently done with a box wine/wine cask/goonbag).

A knockdown vessel and a system and method for transporting liquids and dry goods have been described. It will be understood by those skilled in the art that the present invention may be embodied in other specific forms without departing from the scope of the invention disclosed and that the examples and embodiments described herein are in all respects illustrative and not restrictive. Those skilled in the art of the present invention will recognize that other embodiments using the concepts described herein are also possible. Further, any reference to claim elements in the singular, for example, using the articles "a," "an," or "the" is not to be construed as limiting the element to the singular.

What is claimed is:

1. A knockdown vessel, consisting of:

a cylindrical bladder having a first cylindrical end including a gland, a center cylindrical portion, and a second closed cylindrical end;

a rigid cylindrical center barrel section having a circular cross-section, a first frusti-conical edge, and a second frusti-conical edge, the rigid cylindrical center barrel section being sized to encompass the center cylindrical portion of the bladder;

a rigid first end cylindrical barrel section having an end wall and sized at an opposing end to longitudinally mate to the first frusti-conical edge of the rigid cylindrical center barrel section and dimensioned to encompass the first cylindrical end of the bladder;

a rigid second end cylindrical barrel section having an end wall and sized at an opposing end to longitudinally mate to the second frusti-conical edge of the rigid cylindrical center barrel section and dimensioned to encompass the second cylindrical end of the bladder.

2. The knockdown vessel of claim 1, wherein the rigid first end cylindrical barrel section is sized to nest within the rigid cylindrical center barrel section and the rigid second end cylindrical barrel section is sized to nest within the rigid first end cylindrical barrel section when in a collapsed state.

3. The knockdown vessel of claim 1, the rigid first end cylindrical barrel section further includes a centrally-located bush in the end wall and a recessed portion with an opening for the gland.

4. The knockdown vessel of claim 3, the rigid second end cylindrical barrel section further includes a centrally-located bush in the end wall.

5. The knockdown vessel of claim 4, further consisting of:

a handle frame including lugs that interact with the bushes and prevents the sections from separating along a longitudinal axis.

6. The knockdown vessel of claim 5, wherein the handle frame includes means to convert the handle frame into a support for the vessel.

7. The knockdown vessel of claim 5, wherein the lugs adjustably screw longitudinally into the bushes so as to be easily separable.

8. The knockdown vessel of claim 2, wherein the rigid first and second end cylindrical barrel sections are tapered in a direction towards the end wall of each end cylindrical barrel section.

9. The knockdown vessel of claim 1, the rigid first end cylindrical barrel section further includes a recessed portion with an opening for the gland.

10. The knockdown vessel of claim 9, further consisting of a tap assembly for engaging the gland through the opening.

11. A system for transporting liquids or dry goods, consisting of:

vessel components consisting of:

a cylindrical internal bladder; and a plurality of cylindrical barrel sections sized to encompass the cylindrical bladder when assembled;

a handle comprising means for retaining the plurality of cylindrical barrel sections in an assembled state along a central axis thereof that allows rotation of the vessel about the central axis;

the cylindrical internal bladder including a gland that extends through an external cylindrical barrel section; and means for sealing the gland;

wherein at least two vessel components are storable when disassembled in a nested manner.

12. The system of claim 11, wherein the means for sealing the gland is a tap assembly or a cap.

13. The system of claim 12, wherein the plurality of cylindrical barrel sections consist of a first end cylindrical barrel section dimensioned to nest in a central cylindrical barrel section and a second end cylindrical barrel section dimensioned to nest in the first end cylindrical barrel section.

* * * * *